US005686212A

United States Patent [19]

Tomiuchi et al.

[11] Patent Number: 5,686,212

[45] Date of Patent: Nov. 11, 1997

[54] PHOTOCONDUCTOR FOR ELECTROPHOTOGRAPHY CONTAINING DISTYRYL COMPOUND

[75] Inventors: Yoshimasa Tomiuchi; Masami Kuroda; Osamu Nabeta; Masayo Amano; Yoshimasa Hattori; Noboru Furusho, all of Kawasaki, Japan

[73] Assignee: Fuji Electric Co., Ltd., Kanagawa, Japan

[21] Appl. No.: 546,556

[22] Filed: Oct. 20, 1995

Related U.S. Application Data

[63] Continuation-in-part of Ser. No. 197,598, Feb. 17, 1994, abandoned.

[30] Foreign Application Priority Data

Aug. 19, 1993 [JP] Japan ..... 5-204807

[51] Int. Cl.[6] ..... G03G 5/06

[52] U.S. Cl. ..... 430/56; 430/59; 430/73

[58] Field of Search ..... 430/59, 73, 77, 430/56

[56] References Cited

U.S. PATENT DOCUMENTS

| | | | |
|---|---|---|---|
| 4,111,693 | 9/1978 | Wright et al. | 430/73 |
| 4,886,846 | 12/1989 | Shimada et al. | 430/59 |
| 4,988,594 | 1/1991 | Hattori et al. | 430/59 |
| 5,132,189 | 7/1992 | Kuroda et al. | 430/73 |
| 5,178,981 | 1/1993 | Hattori et al. | 430/59 |

OTHER PUBLICATIONS

Borsenberger, Paul M. and David S. Weiss. Organic Photoreceptors for Imaging Systems. New York: Marcel–Dekker, Inc. pp. 360–361, 1993.

English translation of JP 2–282262, Nov. 1990.

Chemical Abstracts 114:256932, 1991.

Chemical Abstracts 123:156361, 1995.

Chemical Abstracts 115:266819, 1991.

Diamond, Arthur S. (editor). Handbook of Imaging Materials. New York: Marcel–Dekker, Inc. pp. 410–423, 1991.

*Primary Examiner*—Christopher D. Rodee

*Attorney, Agent, or Firm*—Spencer & Frank

[57] ABSTRACT

A photoconductor for electrophotography includes a distyryl compound of the general formula (I) as a charge generation material and a bisazo compound of the general formula (II) as a charge transport material.

(I)

(II)

5 Claims, 1 Drawing Sheet

PHOTOCONDUCTOR FOR ELECTROPHOTOGRAPHY CONTAINING DISTYRYL COMPOUND

CROSS-REFERENCE TO RELATED APPLICATION

This is a Continuation-In-Part Application of Ser. No. 08/197,598 filed on Feb. 17, 1994, abandoned the disclosure of which is incorporated herein by reference.

BACKGROUND OF THE INVENTION

1. Field of the Invention

The present invention relates to a photoconductor for electrophotography to perform an electrophotographic process in a data-processing machine such as a photocopying machine, a facsimile machine, and a laser printer. Especially the present invention relates to a photoconductor for electrophotography that has a photosensitive layer formed by unconventionally combinating a charge generation material and a charge transport material to provide a high sensitivity against illuminated light and excellent properties of image formation under the condition of repeating the image-forming process.

2. Description of the Prior Art

Heretofore, photoconductors for electrophotography (hereinafter also referred as photoconductors) have been manufactured by using photosensitive materials. For example, the material can be selected from: (i) inorganic photoconductive materials such as selenium and selenium alloys; (ii) dispersions of other inorganic photoconductive materials such as zinc oxide and cadmium sulfate in resin binders; (iii) organic photoconductive materials such as poly-N-vinylcarbazole and polyvinylanthracene; and (iv) dispersions of other organic photoconductive materials such as phthalocyanine compounds and bisazo compounds in resin binders, or vacuum depositions of these materials on resin binders.

The photoconductor requires functions of keeping its surface charges in the dark, generating charges by receiving the illuminated light, and transporting the charges by receiving the illuminated light. Therefore, a photosensitive layer of the photoconductor has been classified into two types in general, that is, one is formed as a single layer for performing the functions described above (hereinafter, it will be referred as a mono-type photoconductor) and the other is formed as a layer comprising functionally distinguishable layers (hereinafter, it will be referred as a laminate-type photoconductor). That is, the laminate-type photoconductor comprises a first layer for the function of generating charges and a second layer for the functions of keeping surface charges in the darkness and transporting the charges at the period of receiving the illuminated light. A typical electrophotographic method using the photoconductors described above is known as the Carlson process.

The Carlson process is the electrophotographic process for image formation, that comprises the steps of:

(i) providing charges uniformly on a surface of the photosensitive layer by means of corona discharge in the absence of light;

(ii) exposing a charged surface of the photosensitive layer to light to form a latent image that is a charge pattern on the photosensitive layer that mirrors the information such as characters and figures to be transformed into the real image;

(iii) developing the latent image by applying toner particles that are brought into the vicinity of the latent image to obtain a toner image; and (iv) transferring and fixing the developed toner image on a support medium such as a sheet of paper and plastics, following that the photosensitive layer is discharged and cleaned of any excess toner particles using coronas, lamps, and brushes and scraper blades, or both. Consequently, the image formation can be repeated by using the same photoconductor.

In recent years, the photoconductors using organic materials having been put into practical use by virtue of their advantage features of flexibility, thermal stability, membrane-formability, and the like. That is, for example, a photoconductor comprising poly-N-vinylcarbazole is disclosed in the U.S. Pat. No. 3,484,237, a photoconductor mainly comprising organic pigment is disclosed in Japanese Patent Application Laying-Open No. 47-37,543, and a photoconductor mainly comprising a eutectic complex of pigment and resin is disclosed in Japanese Patent Application Laying-Open No. 47-10,785.

In spite of that the organic materials described above have much more advantages compared with the inorganic one, however, these advantages are not enough to satisfy all of the requirements for the photoconductor. Therefore, there are much more demands for the photoconductor that has a high sensitivity and an excellent repeat performance. The term "repeat performance" means that stable conditions of excellent electrophotographic properties for the image formation to provide good image qualities in the period of repeating the cycles of image formation.

SUMMARY OF THE INVENTION

An object of the present invention is to provide an electrophotographic photoconductor, with a novel combination of a charge generation material and a charge transport material, that has a high sensitivity against the illuminated light and a high durability in the period of repeating the cycles of image formation.

In the first aspect of the present invention, a photoconductor for electrophotography comprises:

an electroconductive substrate; and a photoconductive layer formed on the substrate and including at least one of distyryl compounds represented by the following general formula (I) as a charge transport material and at least one of bisazo compounds represented by the following general formula (II) as a charge generation material:

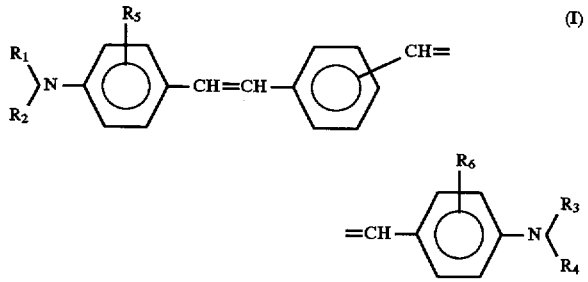

(I)

-continued (II)

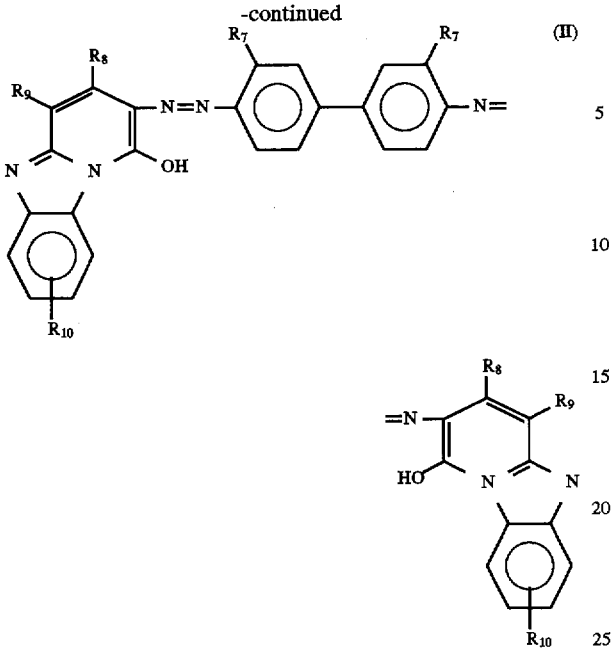

in which $R_1$, $R_2$, $R_3$, $R_4$, $R_5$ and $R_6$ each stand for a hydrogen atom, a substituted or unsubstituted aryl or alkyl group; $R_7$ stands for one of a halogen atom, an alkyl group, and an alkoxyl group; $R_8$ stands for a substituted or unsubstituted alkyl group; $R_9$ stands for one of a hydrogen atom, a cyano group, a carbamoyl group, a carboxyl group, an alkoxycarbonyl group, and an acyl group; $R_{10}$ stands for one of a hydrogen atom, a halogen atom, a nitro group, and a substituted or unsubstituted alkyl or alkoxyl group.

In the second aspect of the present invention, a photoconductor for electrophotography comprises:

an electrophotoconductive substrate; and a photoconductive layer formed on the substrate and including at least one of distyryl compounds represented by the following general formula (I) as a charge transport material and at least one of bisazo compounds represented by the following general formula (III) as a charge generation material:

(I)

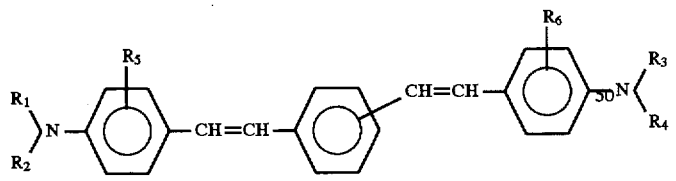

(III)

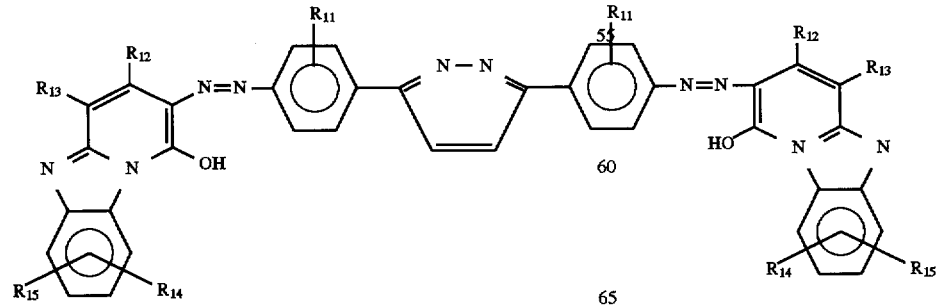

in which $R_1$, $R_2$, $R_3$, $R_4$, $R_5$ and $R_6$ each stand for a hydrogen atom a substituted or unsubstituted aryl or alkyl group; $R_{11}$ stands for one of a hydrogen atom, a halogen atom, and a substituted or unsubstituted alkyl or alkoxyl group; $R_{12}$ stands for a substituted or unsubstituted alkyl, aryl, or aromatic heterocyclic group; $R_{13}$ stands for one of a hydrogen atom, cyano group, a carbamoyl group, a carboxyl group, an alkoxycarbonyl group, and an acyl group; $R_{14}$ and $R_{15}$ each stand for a hydrogen atom, a halogen atom, a nitro group, and a substituted or unsubstituted alkyl or alkoxyl group.

In the third aspect of the present invention, a photoconductor for electrophotography comprises:

an electroconductive substrate; and a photoconductive layer formed on the substrate and including at least one of distyryl compounds represented by the following general formula (I) as a charge transport material and at least one of bisazo compounds represented by the following general formula (IV) as a charge generation material:

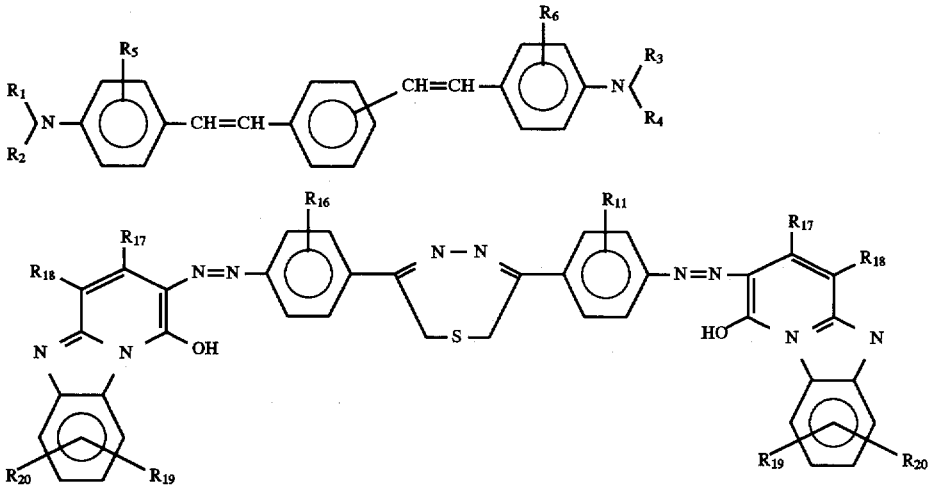

in which $R_1$, $R_2$, $R_3$, $R_4$, $R_5$ and $R_6$ each stand for a hydrogen atom, a substituted or unsubstituted aryl or alkyl group; $R_{16}$ stands for one of a hydrogen atom, a halogen atom, and a substituted or unsubstituted alkyl or alkoxyl group; $R_{17}$ stands for a substituted or unsubstituted alkyl, aryl, or aromatic heterocyclic group; $R_{18}$ stands for one of a hydrogen atom, a cyano group, a carbamoyl group, a carboxyl group, an alkoxylcarbonyl group, and an acyl group; $R_{19}$ and $R_{18}$ each stand for a hydrogen atom, a halogen atom, a nitro group, and a substituted or unsubstituted alkyl or alkoxyl group.

In the fourth aspect of the present invention, a photoconductor for electrophotography comprises:

an electroconductive substrate; and a photoconductive layer formed on the substrate and including at least one of distyryl compounds represented by the following general formula (I) as a charge transport material and at least one of polycyclic quinone compounds represented by the following general formula (V) as a charge generation material:

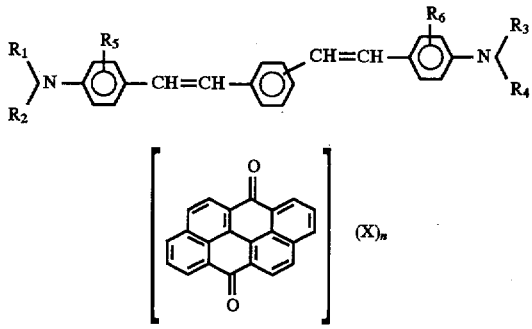

in which $R_1$, $R_2$, $R_3$, $R_4$, $R_5$ and $R_6$ each stand for a hydrogen atom, a substituted or unsubstituted aryl or alkyl group. X stands for one of a hydrogen atom, a halogen group, and a cyano group; and n stands for one integer of from 0 to 4.

In the fifth aspect of the present invention, a photoconductor for electrophotography comprises:

a photoconductive layer formed on the substrate and including at least one of distyryl compounds represented by the following general formula (I) as a charge transport material and at least one of squarylium compounds represented by the following general formula (VI) as a charge generation material:

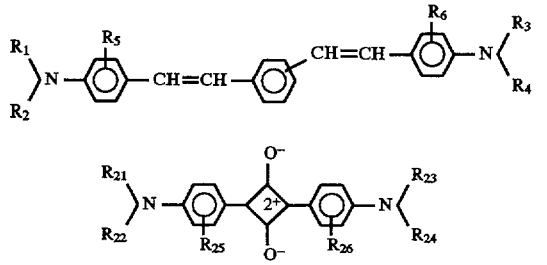

in which $R_1$, $R_2$, $R_3$, $R_4$, $R_5$ and $R_6$ each stand for a hydrogen atom, a substituted or unsubstituted aryl or alkyl group; $R_{21}$, $R_{22}$, $R_{23}$ and $R_{24}$ each stand for a substituted or unsubstituted aryl, alkyl, aralkyl, alkenyl group, in which a ring may be formed between $R_{21}$ and $R_{22}$ or between $R_{23}$ and $R_{24}$; $R_{25}$ and $R_{26}$ each stand for one of a hydrogen atom, a halogen atom, a hydroxyl group, an alkyl group, and an alkoxyl group.

In the sixth aspect of the present invention, photoconductor for electrophotography comprising:

an electroconductive substrate; and a photoconductive layer formed on the substrate and including at least one of distyryl compounds represented by the following general formula (I) as a charge transport material and at least one of a non-metallic phthalocyanine and a titanyl oxyphthalocyanine as a charge generation material:

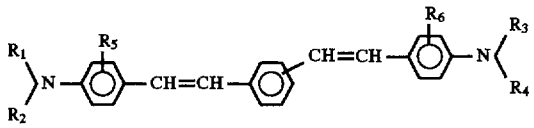

(I)

in which $R_1$, $R_2$, $R_3$, $R_4$, $R_5$ and $R_6$ each stand for a hydrogen atom a substituted or unsubstituted aryl or alkyl group.

The photosensitive layer may comprise a charge generation layer including the charge generation material and a charge transport layer including the charge transport material.

$R_1$, $R_2$, $R_3$, $R_4$, $R_5$ and $R_6$ each may stand for a hydrogen atom, methyl group in the distyryl compound represented by the general formula (I).

$R_7$ may stand for a chlorine atom, $R_8$ may stand for a methyl group, $R_9$ may stand for a cyano group, and $R_{10}$ may stand for a hydrogen atom in the bisazo compound represented by the general formula (II).

$R_{11}$ may stand for a hydrogen atom, $R_{12}$ may stand for a methyl group, $R_{13}$ may stand for a cyano group, and $R_{14}$ and $R_{15}$ each may stand for a hydrogen atom in the bisazo compound represented by the general formula (III).

$R_{16}$ may stand for a hydrogen atom, $R_{17}$ may stand for a methyl group, $R_{18}$ may stand for cyano group, and $R_{19}$ and $R_{20}$ each may stand for a hydrogen atom, in the bisazo compound represented by the general formula (IV).

X may stand for a bromine atom and n may stand for 2 in the polycyclic quinone compound represented by the general formula (V).

$R_{21}$, $R_{22}$, $R_{23}$, and $R_{24}$ each may stand for a methyl group, and $R_{25}$ and $R_{26}$ each may stand for a hydroxyl group in the squarylium compound represented by the general formula (VI).

The photosensitive layer may be covered by a surface coat layer mainly comprising a material selected from a silicone resin; an acrylic denatured silicone resin; an alkyd denatured silicon resin; a polyester denatured silicone resin; a urethane denatured silicon resin; and a mixture thereof with a condensation product of metal alkoxy compounds mainly including $SiO_2$, $TiO_2$, $In_3O_3$, and $ZrO_2$.

The photosensitive layer may comprise a charge generation layer including the charge generation material and a charge transport layer including the charge transport material, and a charge generation layer may be laminated on the electroconductive substrate while the charge transport layer is laminated on the charge generation layer.

The photosensitive layer may comprise a charge generation layer including the charge generation material and a charge transport layer including the charge transport material, and a charge transport layer may be laminated on the electroconductive substrate while the charge generation layer is laminated on the charge transport layer.

The above and other objects, effects, features and advantages of the present invention will become apparent from the following description of embodiments thereof taken in conjunction with the accompanying drawings.

DETAILED DESCRIPTION OF PREFERRED EMBODIMENTS

Figure 1:
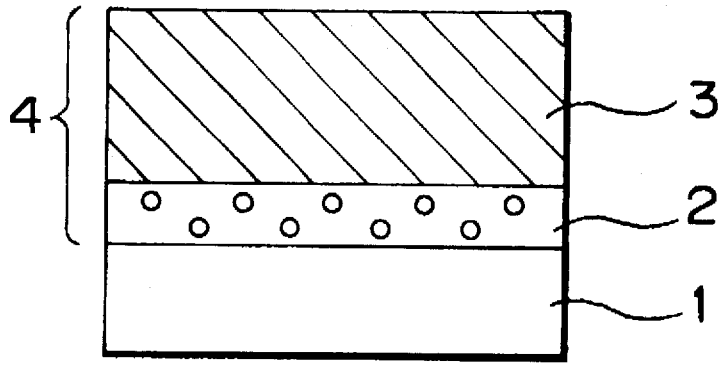
FIG. 1 shows a cross sectional plan view of a photoconductor for electrophotography (a negative charge type) in accordance with the present invention.
Figure 2:
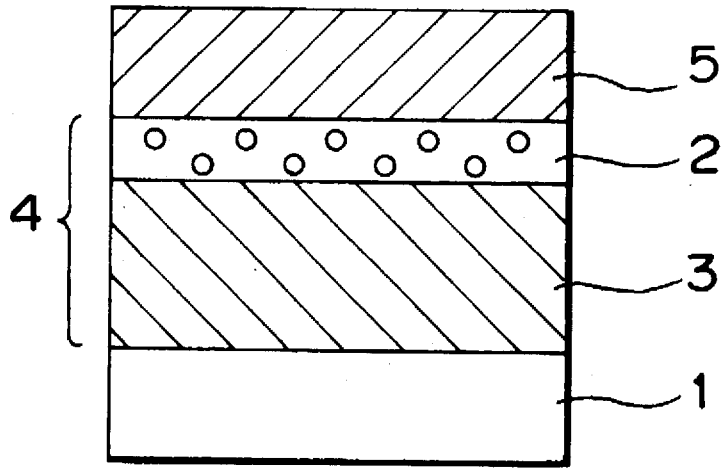
FIG. 2 shows a cross sectional plan view of a photoconductor for electrophotography (a positive charge type) in accordance with the present invention.

FIGS. 1 and 2 show a negative-charge type photoconductor and a positive-charge type photoconductor, respectively, in accordance with the present invention.

In these figures, each reference numeral indicates as follows. That is, 1 indicates an electroconductive substrate, 2 indicates a charge generation layer, 3 indicates a charge transport layer, 4 indicates a photosensitive layer, and 5 indicates a surface-cover layer.

The photosensitive layer is in the type of having functionally distinguishable layers: the charge generation layer and the charge transport layer. In addition, the photosensitive layer in FIG. 1 is a negatively charged type and the charge transport layer is laminated on the charge generation layer, while on the contrary the photosensitive layer in FIG. 2 is a positively charged type and the charge generation layer is laminated on the charge transport layer.

The electroconductive substrate 1 serves as an electrode of the photoconductor and as a support for other layers. Also, the electroconductive substrate may be in the form of a cylinder, a plate, or a film, and also may be made of a metallic material such as aluminum, stainless steel, nickel, or the like; or other material such as plastics, glass, paper, or the like having a surface treated to be electroconductive by means of metallization, metal plating, electroconductive coating, or the like.

The charge generation layer 2 is formed by means of a vacuum deposition of the organic photoconductive material or by means of a dispersion of the organic photoconductive material in the resin binder. The charge generation layer 2 is responsible for receiving the illuminated light and generating charges. It is preferable to obtain a high rate of generating the charges from the charge generation layer 2 and a high rate of injecting the generated charges into the charge transport layer 3 with a low dependency on the electric field. That is, it is preferable to inject the charges smoothly into the charge transport layer under the low electric field.

The charge generation layer only requires a function of generating charges, so that its membrane thickness can be determined depending on a coefficient of light absorption. That is, in general, it is in the range of 5 μm or under, or preferably 1 μm or under. It may be also possible to form a charge generation layer using a charge generation material as a principal constituent in admixture with a charge transport material or the like. Furthermore, a resin binder to be used in the charge generation layer can be selected from materials of polycarbonate, polyester, polyamide, polyurethane, polyvinylbutiral, phenoxy, epoxy, and silicone resins, and methacrylate ester polymers and copolymers, which can be used either alone or in appropriate combination.

The charge transport layer 3 is a membrane to be applied on the electroconductive substrate and is formed by dispersing an organic transport material in a resin binder. The charge transport layer 3 serves as an insulator layer in the dark so as to retain the electric charge of the photosensitive layer, and fulfills, a function of transporting the electric charge injected from the charge generation layer upon receiving the illuminated light. A resin binder to be provided in the charge transport layer can be selected from a group of polymers or copolymers of polycarbonate, polyester, polystyrene, methacrylate ester, and the like. From the practical viewpoint, however, the raw material of the resin binder should be in the type of not only providing the binder with properties of adhesion and a mechanical, chemical, and electrical stability but also providing the layer with a good affinity against the charge transport material.

A thickness of the charge transport layer is preferably in the range of 3–50 μm, more preferably in the range of 10–40 μm, for retaining an effective surface potential in practical use.

The surface coat layer 5 is made of a chemically stable material with excellent durability against mechanical stress. The surface coat layer 5 is responsible for receiving and keeping the charges of a corona discharge in the dark and also responsible for transmitting the illuminated light to be sensed by the charge generation layer. For neutralizing and disappearing the surface charge by injecting the generated charges, therefore, it is required that the surface coat layer 5 passes the light therethrough to the charge generation layer during the period of the exposure. In addition, the coat material may be capable of transmitting light at a wavelength of the maximum light absorption of the charge generation material.

The materials applicable to the surface coat layer are denatured silicone resins such as acrylic denatured silicone resin, epoxy denatured silicone resin, alkyd denatured silicone resin, polyester denatured silicone resin, and urethane denatured silicone resin, and hard coat agents such as silicone resin. It is possible to solely use one of the denatured silicone resins, but it is preferable to mix with a condensation product of metal alkoxy compounds which is able to form a cover mainly comprising $SiO_2$, $TiO_2$, $In_2O_3$, $ZrO_2$, for the purpose of improving the durability of the layer.

A thickness of the coat layer is depended on the mixing composition, but it is possible to determine the thickness within the range of without causing any troubles such as an increase in residual potential during the repeated cycles of image formation.

EXAMPLE 1

1 part by weight of a bisazo compound represented by the general formula II-1 as a charge generation material and 1 part by weight of a diallylphthalate resin (trade mark: Dap-K, Osaka Soda Co., Ltd.) as a binder resin were mixed with 150 parts by weight of methylethylketone and stirred for 3 hours by the mixer to prepare a coating solution to be applied as a charge generation layer. In addition, 1 part by weight of a distyryl compound represented by the general formula I-1 as a charge transport material and a polycarbonate resin (trade mark: Panlight L-1225, Teijin Chemical Industry Co., Ltd.) as a binder resin were solved in 6 parts by weight of dichrolomethane to prepare a coating solution to be applied as a charge transport layer. Then the coating solutions were applied on an aluminum-deposited polyetherphthalate film in the order to form the charge generation layer (1 μm thickness) as a lower and the charge transport layer (20 μm thickness) as an upper layer, resulting that a photoconductor for negative charge was obtained.

EXAMPLE 2

A photoconductor was prepared by the same manner as that of Example 1, except that a chemical compound referred as the general formula I-16 was used as a charge transport material.

EXAMPLE 3

A photoconductor was prepared by the same manner as that of Example 1, except that a chemical compound referred as the general formula I-17 was used as a charge transport material.

EXAMPLE 4

A photoconductor was prepared by the same manner as that of Example 1, except that a chemical compound referred as the general formula I-24 was used as a charge transport material.

EXAMPLE 5

A photoconductor was prepared by the same manner as that of Example 1, except that a bisazo compound referred as the general formula III-1 was used as a charge generation material.

EXAMPLE 6

A photoconductor was prepared by the same manner as that of Example 2, except that a bisazo compound referred as the general formula III-1 was used as a charge generation material.

EXAMPLE 7

A photoconductor was prepared by the same manner as that of Example 3, except that a bisazo compound referred as the general formula III-1 was used as a charge generation material.

EXAMPLE 8

A photoconductor was prepared by the same manner as that of Example 4, except that a bisazo compound referred as the general formula III-1 was used as a charge generation material.

EXAMPLE 9

A photoconductor was prepared by the same manner as that of Example 1, except that a bisazo compound refereed as the general formula IV-1 was used as a charge generation material.

EXAMPLE 10

A photoconductor was prepared by the same manner as that of Example 2, except that a bisazo compound refereed as the general formula IV-1 was used as a charge generation material.

EXAMPLE 11

A photoconductor was prepared by the same manner as that of Example 3, except that a bisazo compound refereed as the general formula IV-1 was used as a charge generation material.

EXAMPLE 12

A photoconductor was prepared by the same manner as that of Example 4, except that a bisazo compound refereed as the general formula IV-1 was used as a charge generation material.

EXAMPLE 13

A photoconductor was prepared by the same manner as that of Example 1, except that a poly-cyclic quinone compound referred as the general formula V-4 was used as a charge generation material.

EXAMPLE 14

A photoconductor was prepared by the same manner as that of Example 2, except that a poly-cyclic quinone compound referred as the general formula V-4 was used as a charge generation material.

EXAMPLE 15

A photoconductor was prepared by the same manner as that of Example 3, except that a poly-cyclic quinone compound referred as the general formula V-4 was used as a charge generation material.

EXAMPLE 16

A photoconductor was prepared by the same manner as that of Example 4, except that a poly-cyclic quinone compound referred as the general formula V-4 was used as a charge generation material.

EXAMPLE 17

A photoconductor was prepared by the same manner as that of Example 1, except that a squarylium compound referred as the general formula VI-8 was used as a charge generation material.

EXAMPLE 18

A photoconductor was prepared by the same manner as that of Example 2, except that a squarylium compound referred as the general formula VI-8 was used as a charge generation material.

EXAMPLE 19

A photoconductor was prepared by the same manner as that of Example 3, except that a squarylium compound referred as the general formula VI-8 was used as a charge generation material.

EXAMPLE 20

A photoconductor was prepared by the same manner as that of Example 4, except that a squarylium compound referred as the general formula VI-8 was used as a charge generation material.

EXAMPLE 21

A photoconductor was prepared by the same manner as that of Example 1, except that an X-type non-metal phthalocyanine was used as a charge generation material.

EXAMPLE 22

A photoconductor was prepared by the same manner as that of Example 2, except that an X-type non-metal phthalocyanine was used as a charge generation material.

EXAMPLE 23

A photoconductor was prepared by the same manner as that of Example 1, except that a β-type titanyl oxyphthalocianine was used as a charge generation material.

EXAMPLE 24

A photoconductor was prepared by the same manner as that of Example 2, except that a β-type titanyl oxyphthalocianine was used as a charge generation material.

EXAMPLE 25

A photoconductor was prepared by the same manner as that of Example 1, except that coating solutions were applied on an aluminum-deposited polyester phthalate film in the order to form a charge transport layer (20 μm thickness) as a lower layer and a charge generation layer (1 μm thickness) as an upper layer, resulting that a photoconductor for positive charge was obtained.

Comparative Example 1

A photoconductor was prepared by the same manner as that of Example 1, except that a 1-phenyl-3-(p-diethylaminostyryl)-5-(para-diethylaminophenyl)-2-pyrazoline (ASPP) was used as a charge transport material.

Comparative Example 2

A photoconductor was prepared by the same manner as that of Example 1, except that a p-diethyl aminobenzaldehyde-diphenyl hydrazone (ABPH) was used as a charge transport material.

Comparative Example 3

A photoconductor was prepared by the same manner as that of Example 5, except that a 1-phenyl-3-(p-diethylaminostyryl)-5-(para-diethylaminophenyl)-2-pyrazoline (ASPP) was used as a charge transport material.

Comparative Example 4

A photoconductor was prepared by the same manner as that of Example 5, except that a p-diethylaminobenzaldehyde-diphenyl hydrazone (ABPH) was used as a charge transport material.

Comparative Example 5

A photoconductor was prepared by the same manner as that of Example 9, except that a-1-phenyl-3-(p-diethylaminostyryl)-5-(para-diethylaminophenyl)-2-pyrazoline (ASPP) was used as a charge transport material.

Comparative Example 6

A photoconductor was prepared by the same manner as that of Example 9, except that a-p-diethylaminobenzaldehyde-diphenyl hydrazone (ABPH) was used as a charge transport material.

Comparative Example 7

A photoconductor was prepared by the same manner as that of Example 13, except that a-1-phenyl-3-(p-diethylaminostyryl)-5-(para-diethylaminophenyl)-2-pyrazoline (ASPP) was used as a charge transport material.

Comparative Example 8

A photoconductor was prepared by the same manner as that of Example 13, except that a-p-diethylaminobenzaldehyde-diphenyl hydrazone (ABPH) was used as a charge transport material.

Comparative Example 9

A photoconductor was prepared by the same manner as that of Example 17, except that a-1-phenyl-3-(p-diethylaminostyryl)-5-(para-diethylaminophenyl)-2-pyrazoline (ASPP) was used as a charge transport material.

Comparative Example 10

A photoconductor was prepared by the same manner as that of Example 17, except that a-p-diethylaminobenzaldehyde-diphenyl hydrazone (ABPH) was used as a charge transport material.

Comparative Example 11

A photoconductor was prepared by the same manner as that of Example 21, except that a-1-phenyl-3-(p-diethylaminostyryl)-5-(para-diethylaminophenyl)-2-pyrazoline (ASPP) was used as a charge transport material.

Comparative Example 12

A photoconductor was prepared by the same manner as that of Example 21, except that a-p-diethylaminobenzaldehyde-diphenyl hydrazone (ABPH) was used as a charge transport material.

Comparative Example 13

A photoconductor was prepared by the same manner as that of Example 23, except that a-1-phenyl-3-(p-diethylaminostyryl)-5-(para-diethylaminophenyl)-2-pyrazoline (ASPP) was used as a charge transport material.

Comparative Example 14

A photoconductor was prepared by the same manner as that of Example 23, except that a-p-diethylaminobenzaldehyde-diphenyl hydrazone (ABPH) was used as a charge transport material.

Comparative Example 15

A photoconductor was prepared by the same manner as that of Comparative Example 1, except that the coating solutions were applied on an aluminum-deposited polyester phthalate film in the order to form the charge transport layer (20 μm thickness) as a lower layer and the charge generation layer (1 μm thickness) as an upper layer, resulting that a photoconductor for positive charge was obtained.

Comparative Example 16

A photoconductor was prepared by the same manner as that of Example 1, except that the a chlorodianblue was used as a charge generation material.

Comparative Example 17

A photoconductor was prepared by the same manner as that of Example 21, except that the an ε type copper phthalocyanine was used as a charge generation material.

The photoconductors thus obtained were subjected to the following test using the electrostatic charge testing apparatus (Model: "SP-428" manufactured by Kawaguchi Denki Seisakusho) to evaluate their electrophotographic properties.

The surface of the photoconductor was charged in the dark by corona discharge at −6.0 kv or +6.0 kV for 10 seconds to obtain a surface potential $V_S$ (V) of the photoconductor. Subsequently, the photoconductor was kept in the dark for 2 seconds without the corona discharge and then a surface potential $V_D$ (V) was measured. Then the surface of the photoconductor was irradiated with white light at an illuminance of 2 luxes of with 800 nm monochromatic light at an illuminance of 1 μJ/cm². The exposure amount required for the irradiation to decrease the surface potential $V_D$ of the photoconductor for one half to the initial was calculated as an amount of the half decay exposure $E_{1/2}$ (lux·sec) or $E_{1/2}$ (μJ/cm²), and also the surface potential of the photoconductor after the illumination was defined as a residual potential $V_r$ (V). The results thus obtained are listed in Tables 1 and 2 below.

TABLE 1:

(white light at an illuminance of 2 luxes)

| | Vs (volts) | Vr (volts) | $E_{1/2}$ (lux.sec) |
|---|---|---|---|
| Examples | | | |
| 1 | −685 | −20 | 1.17 |
| 2 | −690 | −25 | 1.26 |
| 3 | −675 | −25 | 1.22 |
| 4 | −665 | −20 | 1.25 |
| 5 | −680 | −30 | 1.17 |
| 6 | −650 | −15 | 1.25 |
| 7 | −670 | −35 | 1.21 |
| 8 | −685 | −20 | 1.19 |
| 9 | −690 | −25 | 1.23 |
| 10 | −665 | −30 | 1.16 |
| 11 | −680 | −20 | 1.11 |
| 12 | −675 | −25 | 1.19 |
| 13 | −670 | −20 | 1.31 |
| 14 | −690 | −35 | 1.20 |
| 15 | −685 | −30 | 1.28 |
| 16 | −670 | −20 | 1.19 |
| 17 | −685 | −15 | 1.23 |
| 18 | −660 | −25 | 1.17 |
| 19 | −685 | −30 | 1.23 |
| 20 | −655 | −10 | 1.30 |
| 25 | +650 | +60 | 1.80 |

TABLE 2

(white light at an illuminance of 2 luxes)

| | Vs (volts) | Vr (volts) | $E_{1/2}$ (lux.sec) |
|---|---|---|---|
| Comparative Examples | | | |
| 1 | −680 | −75 | 1.82 |
| 2 | −690 | −90 | 1.94 |
| 3 | −670 | −85 | 1.85 |
| 4 | −685 | −95 | 1.99 |
| 5 | −670 | −100 | 2.06 |
| 6 | −680 | −90 | 1.92 |
| 7 | −685 | −80 | 1.88 |
| 8 | −685 | −75 | 1.81 |
| 9 | −690 | −95 | 1.97 |
| 10 | −680 | −80 | 1.86 |
| 15 | +650 | +190 | 3.25 |
| 16 | −690 | −120 | 2.45 |

TABLE 3

(800 nm monochromatic light at an illuminance of 1 μJ/cm²)

| | Vs (volts) | Vr (volts) | $E_{1/2}$ (μJ/cm²) |
|---|---|---|---|
| Examples | | | |
| 21 | −690 | −15 | 0.60 |
| 22 | −695 | −10 | 0.55 |

TABLE 3-continued (800 nm monochromatic light at an illuminance of 1 μJ/cm²)

| | Vs (volts) | Vr (volts) | $E_{1/2}$ (μJ/cm²) |
|---|---|---|---|
| 23 | −700 | −5 | 0.40 |
| 24 | −705 | −5 | 0.35 |

TABLE 4

(800 nm monochromatic light at an illuminance of 1 μJ/cm²)

| | Vs (volts) | Vr (volts) | $E_{1/2}$ (μJ/cm²) |
|---|---|---|---|
| Comparative Examples | | | |
| 11 | −680 | −35 | 0.95 |
| 12 | −685 | −30 | 0.90 |
| 13 | −690 | −20 | 0.75 |
| 14 | −695 | −29 | 0.75 |
| 17 | −685 | −50 | 1.05 |

As can be seen from Tables 1 and 2, the photoconductors of Examples 1–20 and 25 show almost the same surface potentials compared with that of comparative Examples 1–10, 15 and 16. And, as can be seen from Tables 3 and 4, the photoconductors of Examples 21–24 show almost the same surface potentials compared with that of Comparative Examples 21–24 show almost the same surface potentials compared with that of comparative Examples 11–14, and 17. Regarding the residual potential and the amount of the half decay exposure, however, the photoconductor of each example are much improved, evidently. Because of the result of combining between the distyryl compound as the charge transport material represented by the general formula (I); and the bisazo compound as the charge generation material represented by the general formula (II), (III), (IV), or polycyclic quinone compound (V), or squarylium compound represented by the general formula (VI) or phthalocyanine compound the photoconductor in accordance with the present invention shows excellent electrophotographic properties compared with that of the conventional one.

In accordance with the present invention, as described above, the photoconductor for electrophotography to be used in a data-processing machine in the type of using an electrophotographic method, such as a photocopying machine, facsimile machine, and a laser printer, can be obtained by preparing the combination between: distyryl compound as the charge transport material represented by the general formula (I); and bisazo compound as the charge generation material represented by the general formula (II), (III), (IV), or polycyclic quinone compound represented by the general formula (V), or squarylium compound represented by the general formula (VI) or phthalocyanine compound.

Furthermore, the chemical compounds used in Examples 1–25 and Comparative Examples 1–17 are listed below, but the present invention is not limited to these examples.

(1) The general formula (I) and its concrete examples (I-1)–(I-24) are listed below.

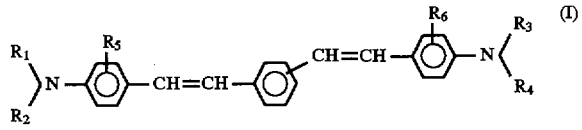

(I)

wherein $R_1$, $R_2$, $R_3$, $R_4$, $R_5$ and $R_6$ each stand for a hydrogen atom, substituted or unsubstituted aryl or alkyl group; $R_{25}$ and $R_{26}$ each stand for one of hydrogen atom, a halogen atom, an alkyl group, and an alkoxyl group; and A stands for a coupler residual group.

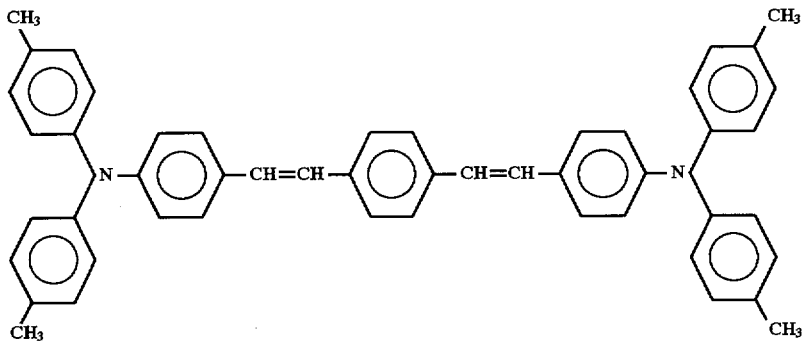

(I-1)

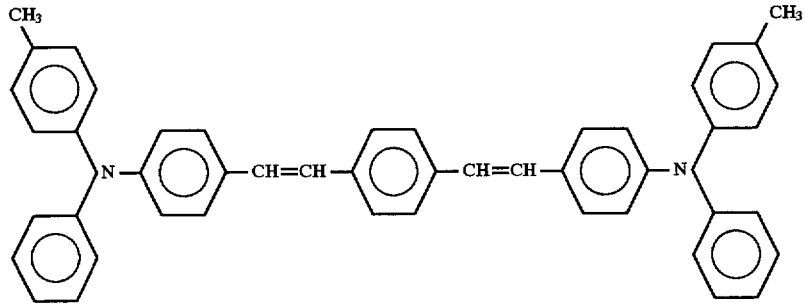

(I-2)

-continued
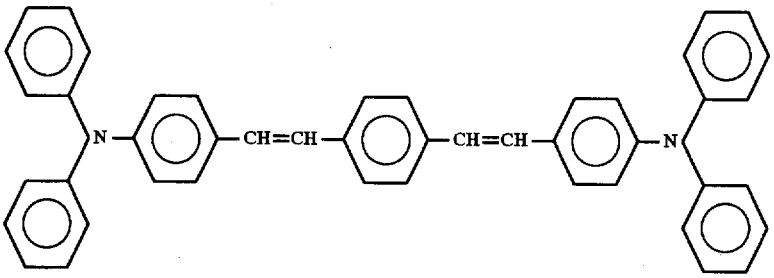
(I-3)
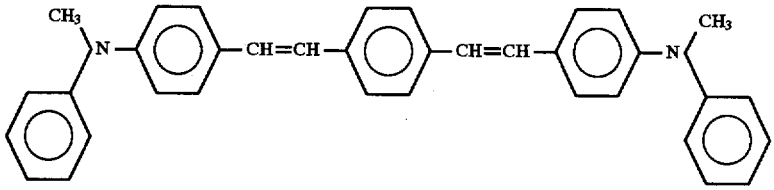
(I-4)
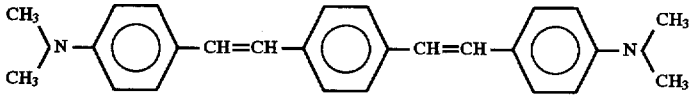
(I-5)
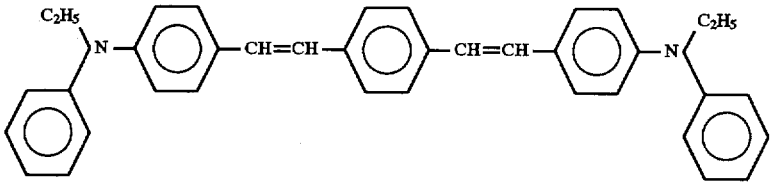
(I-6)
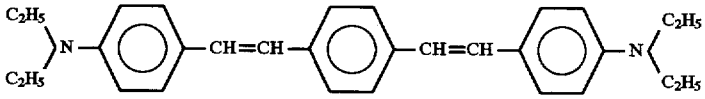
(I-7)
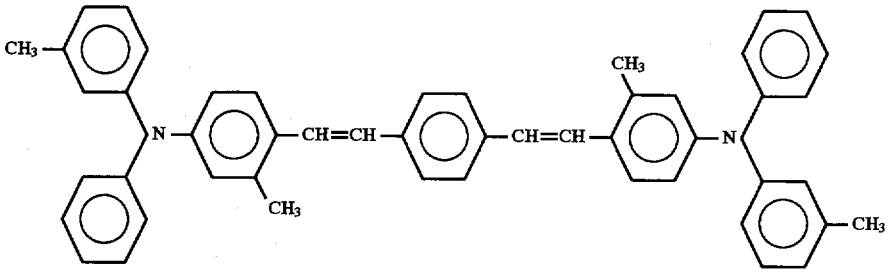
(I-8)
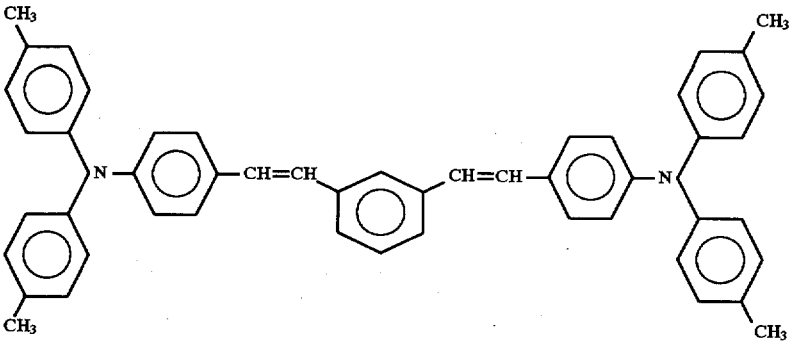
(I-9)

-continued
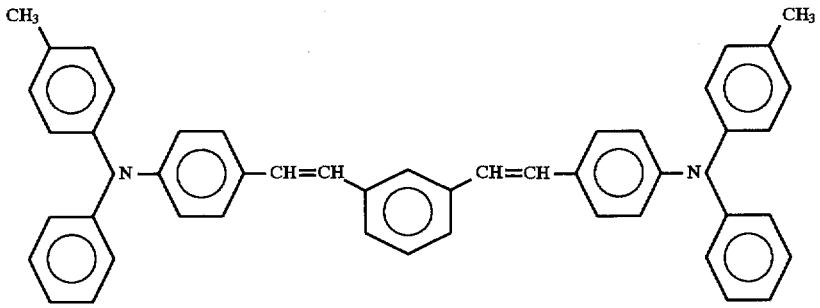
(I-10)
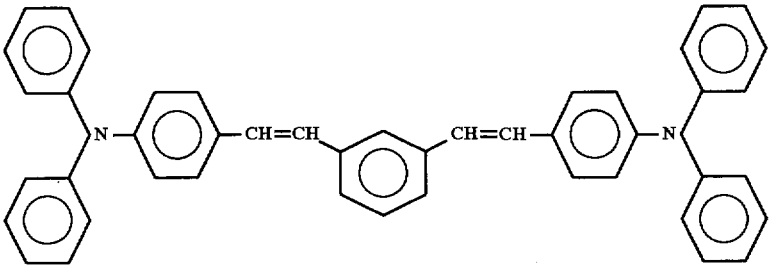
(I-11)
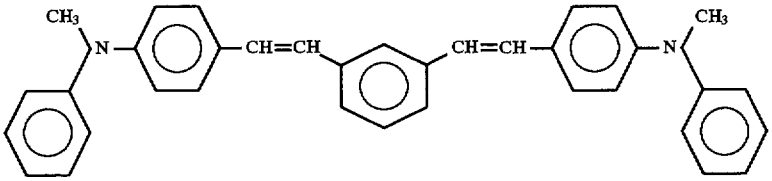
(I-12)
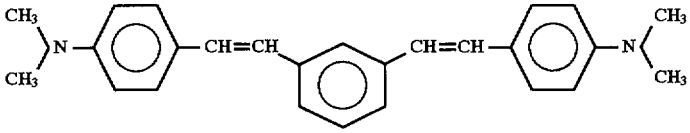
(I-13)
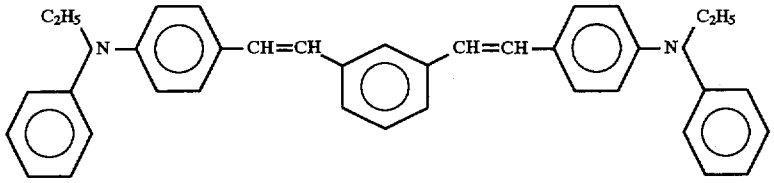
(I-14)
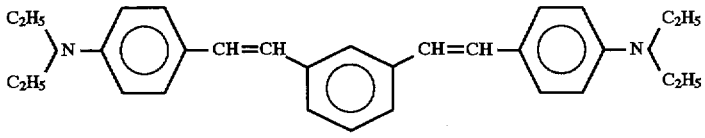
(I-15)
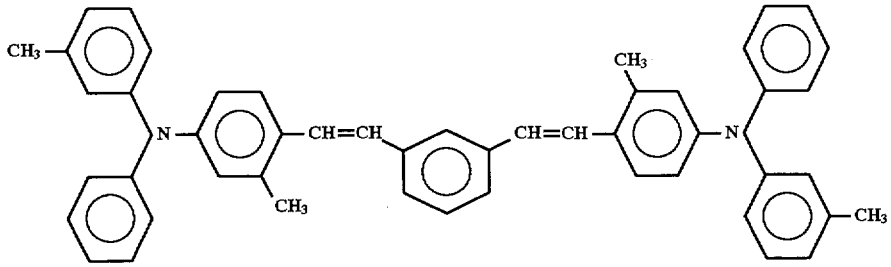
(I-16)

-continued
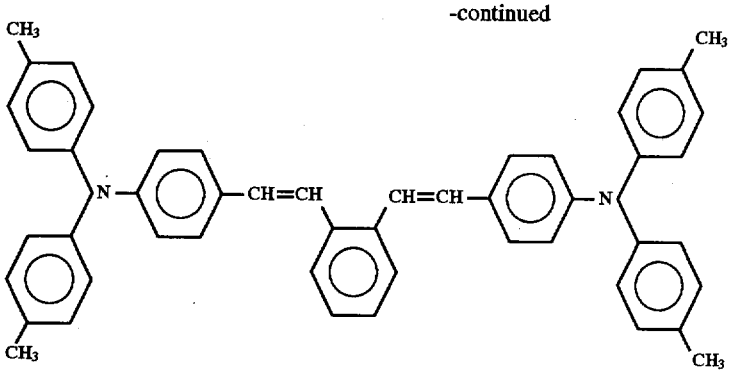
(I-17)
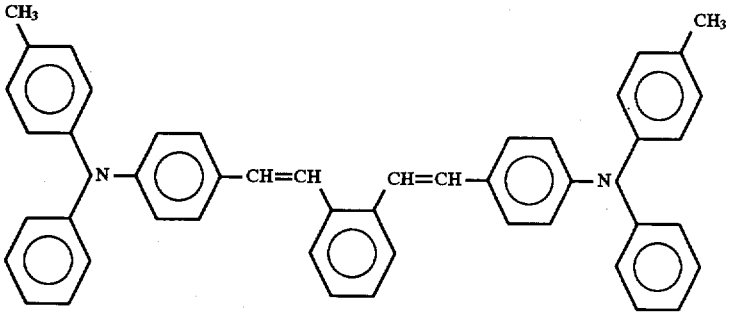
(I-18)
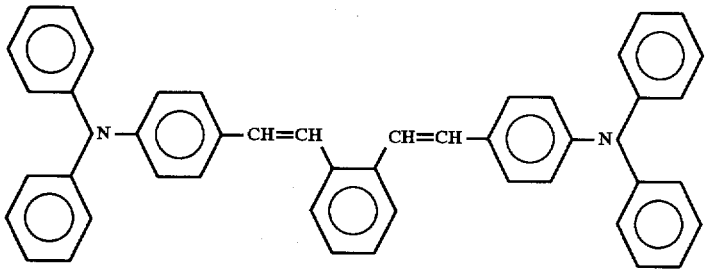
(I-19)
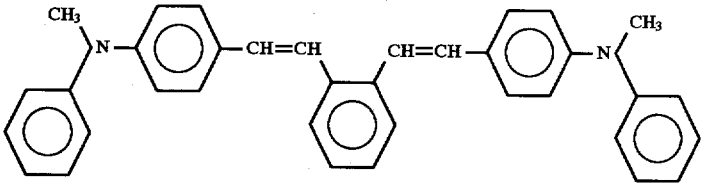
(I-20)
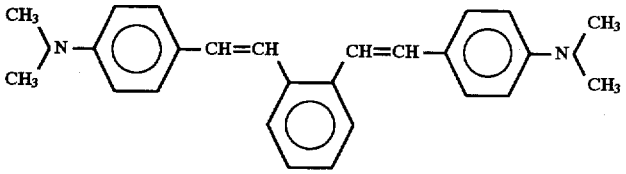
(I-21)
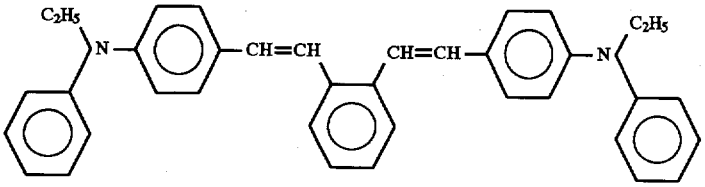
(I-22)
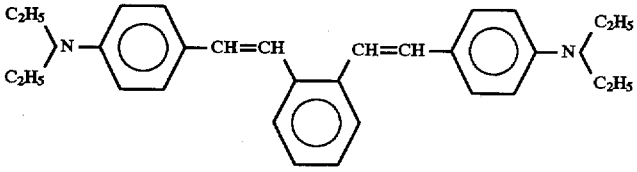
(I-23)

-continued (I-24)

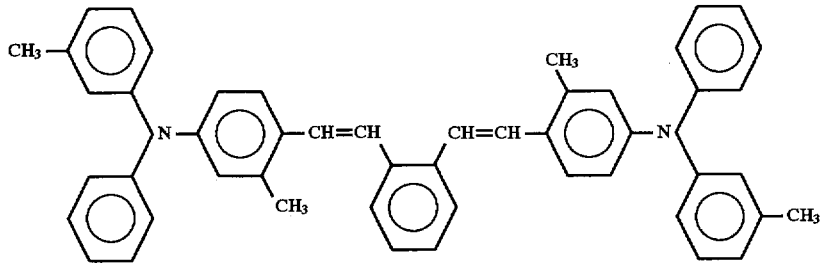

(2) The general formula (II) and its concrete examples (II-1)–(II-6) are listed below.

(II)

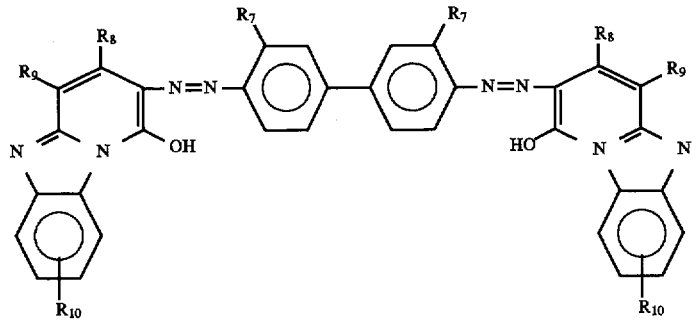

wherein $R_5$ stands for one of a halogen atom, an alkyl group, and an alkoxyl group; $R_6$ stands for a substituted or unsubstituted alkyl group; $R_7$ stands for one of a hydrogen atom, a cyano group, a carbamoyl group, a carboxyl group, an alkoxycarbonyl group, and an acyl group; and $R_8$ stands for one of a hydrogen atom, halogen atom, nitro group, and a substituted or unsubstituted alkyl or alkoxyl group.

(II-1)

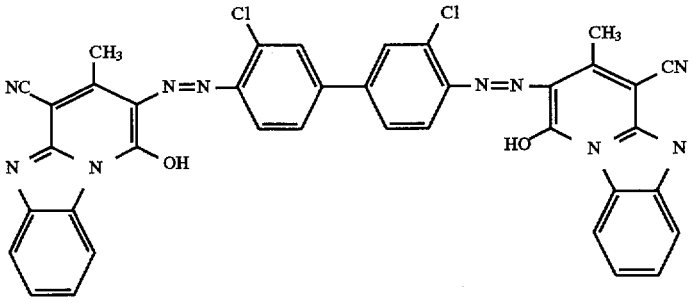

(II-2)

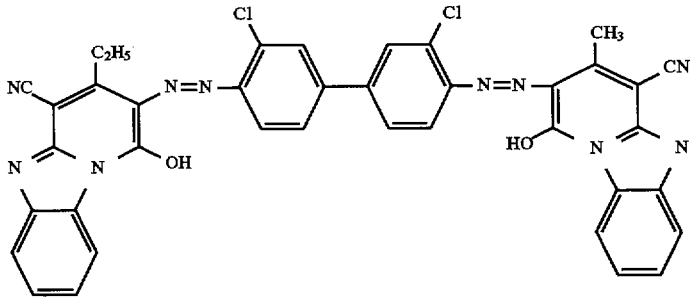

-continued
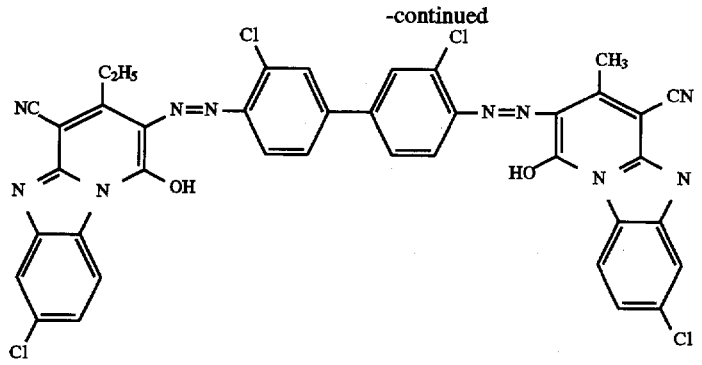
(II-3)
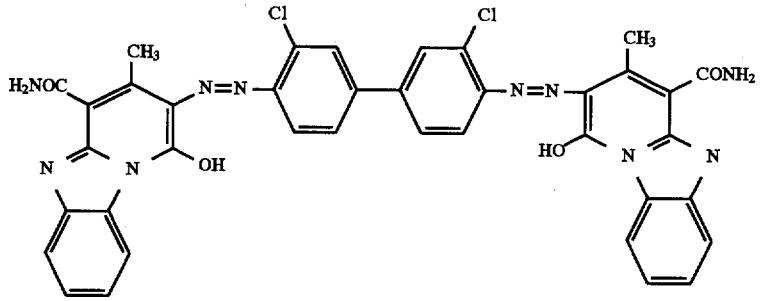
(II-4)
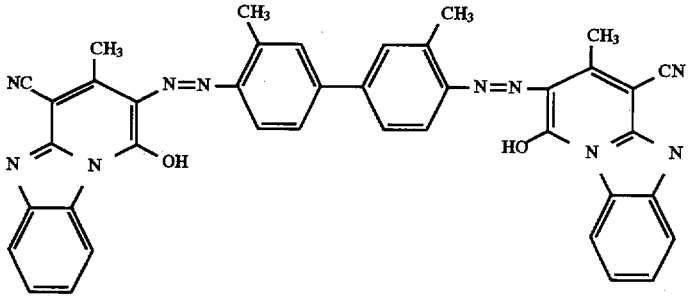
(II-5)
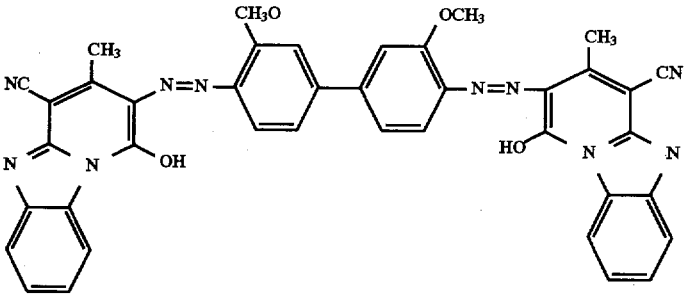
(II-6)
(3) The general formula (III) and its concrete examples (III-1)–(III-10) are listed below.
wherein $R_9$ stands for one of a hydrogen atom, a halogen atom, and a substituted or unsubstituted alkyl or alkoxyl
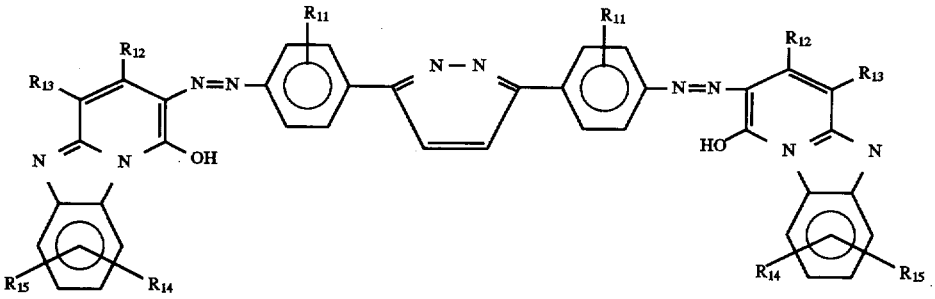
(III)

group; $R_{10}$ stands for a substituted or unsubstituted alkyl, aryl, or aromatic heterocyclic group; $R_{11}$ stands for one of a hydrogen atom, cyano group, a carbamoyl group, a carboxyl group, an alkoxycarbonyl group, and an acyl group; $R_{12}$ and $R_{13}$ each stand for a hydrogen atom, a halogen atom, a nitro group, and a substituted or unsubstituted alkyl or alkoxyl group.

(III-1)

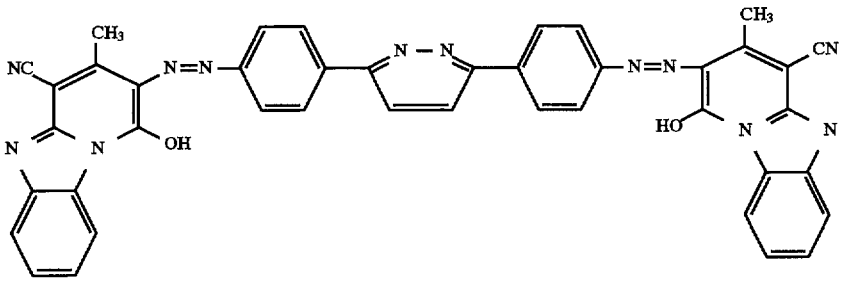

(III-2)

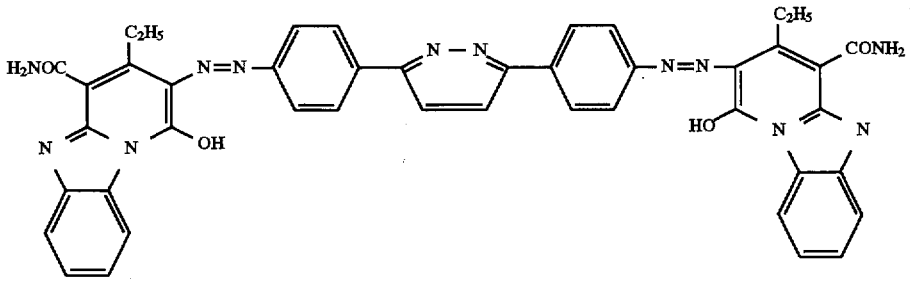

(III-3)

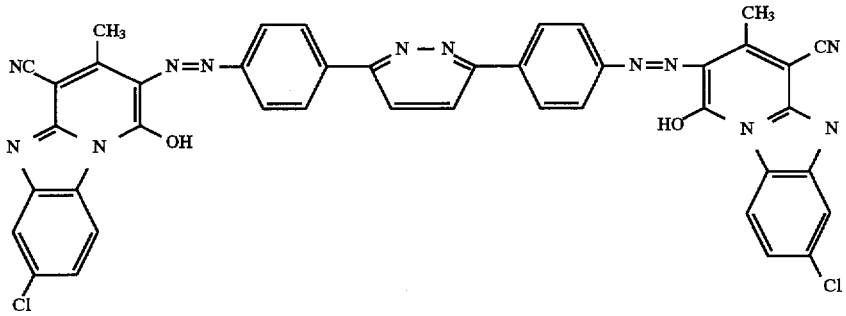

(III-4)

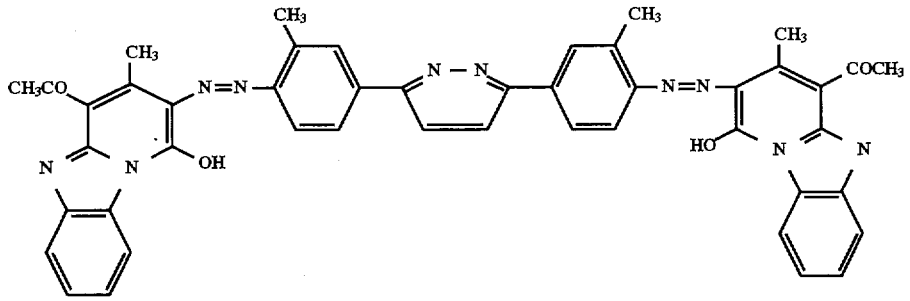

(III-5)

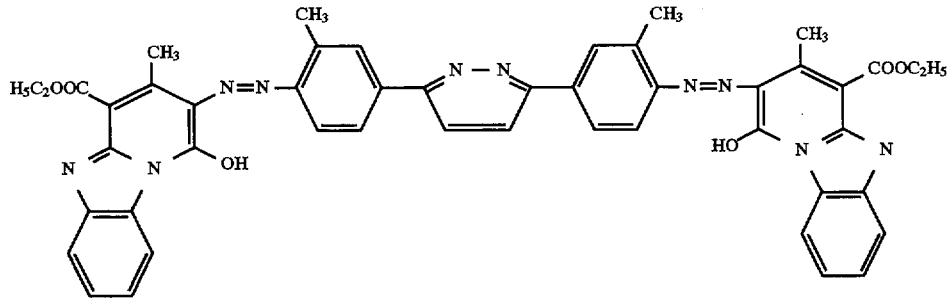

-continued
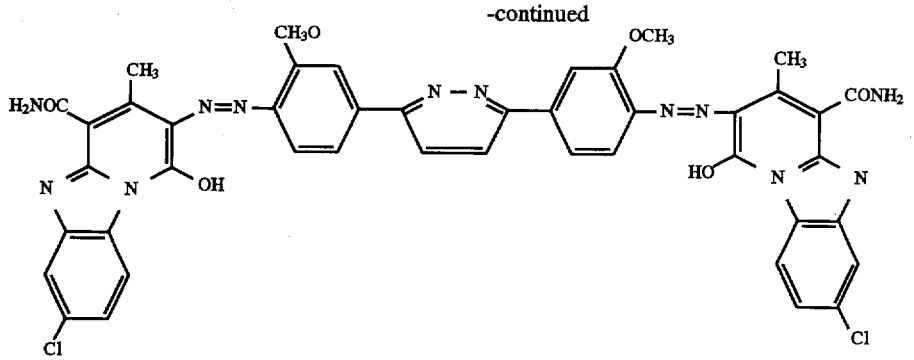
(III-6)
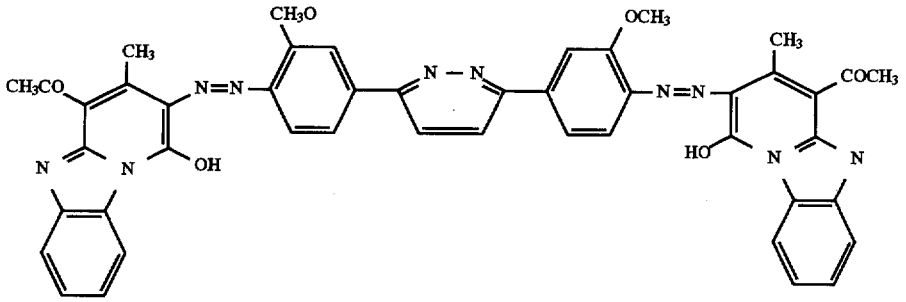
(III-7)
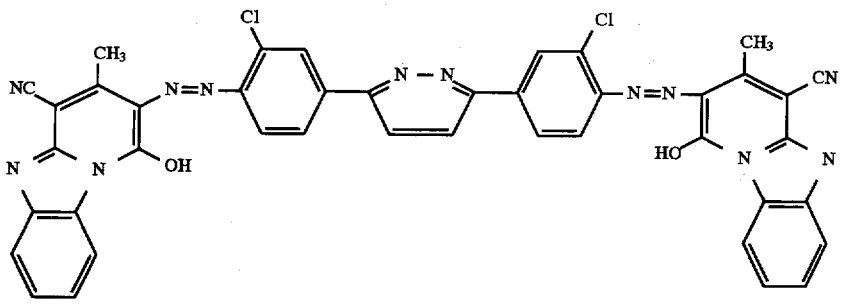
(III-8)
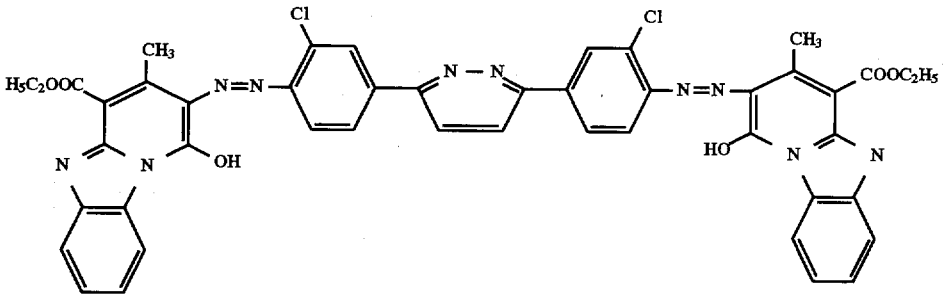
(III-9)
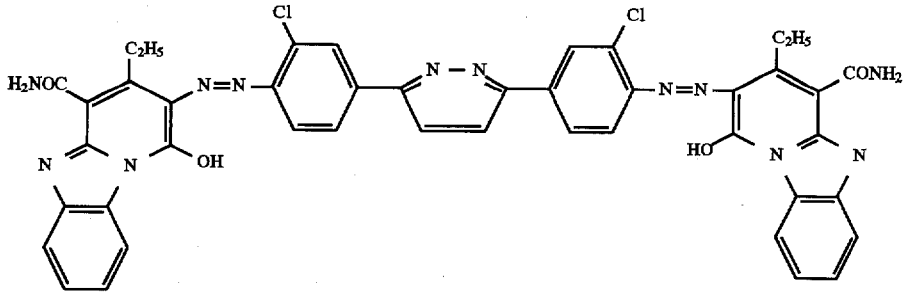
(III-10)
(4) The general formula (IV) and its concrete examples (IV-1)–(IV-5) are listed below.

(IV)

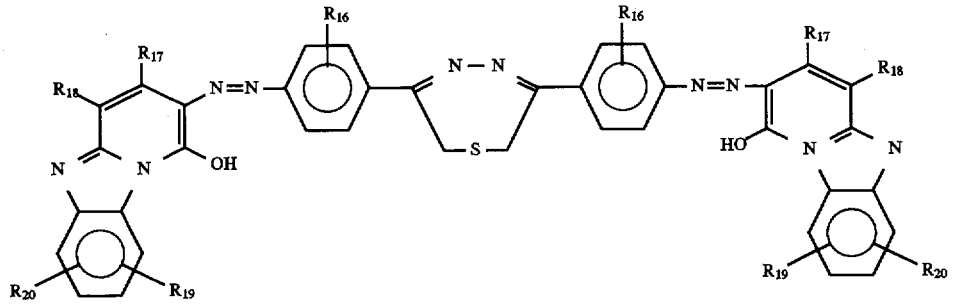

wherein $R_{14}$ stands for one of a hydrogen atom, a halogen atom, and a substituted or unsubstituted alkyl or alkoxyl group; $R_{15}$ stands for a substituted or unsubstituted alkyl, aryl, or aromatic heterocyclic group, $R_{16}$ stands for one of a hydrogen atom, cyano group, a carbamoyl group, a carboxyl group, an alkoxycarbonyl group, and an acyl group; and $R_{17}$ and $R_{18}$ each stand for a hydrogen atom, a halogen atom, a nitro group, and a substituted or unsubstituted alkyl or alkoxyl group.

(IV-1)

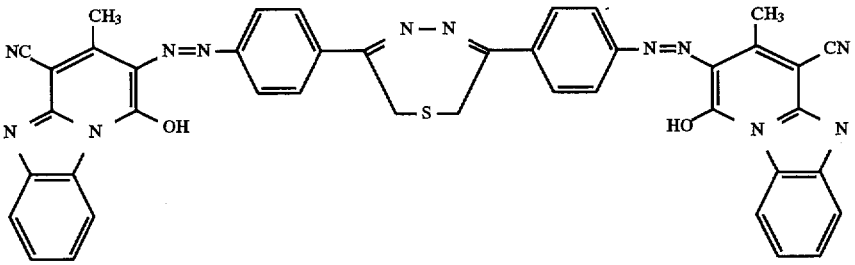

(IV-2)

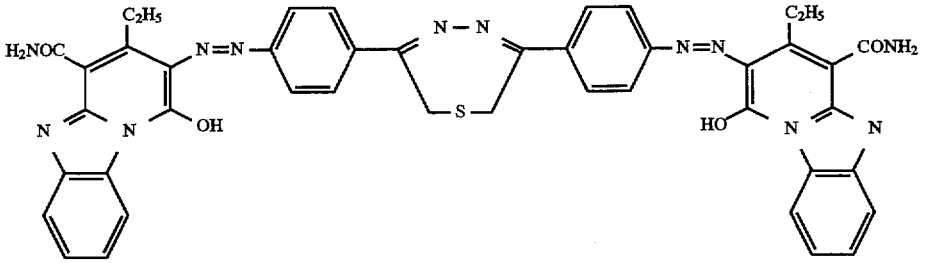

(IV-3)

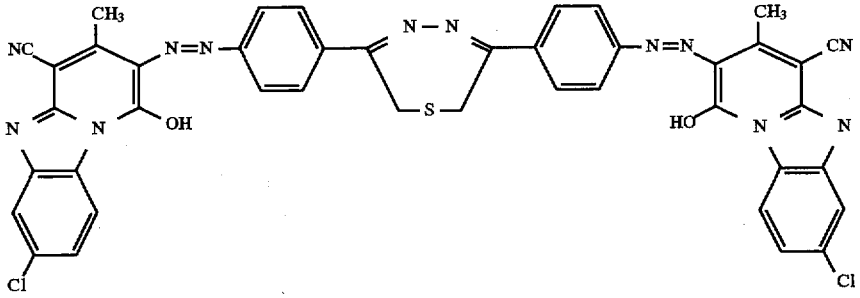

(IV-4)

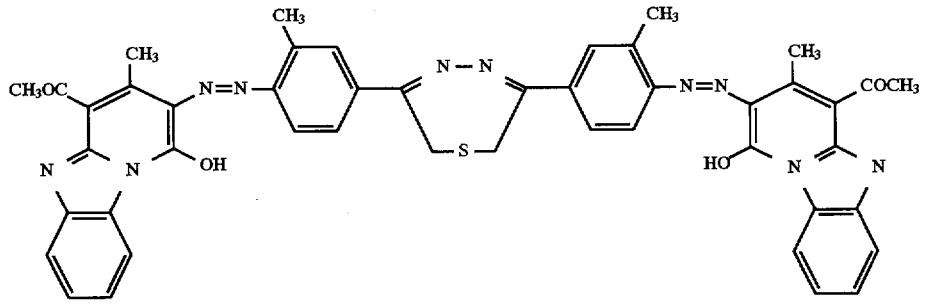

-continued
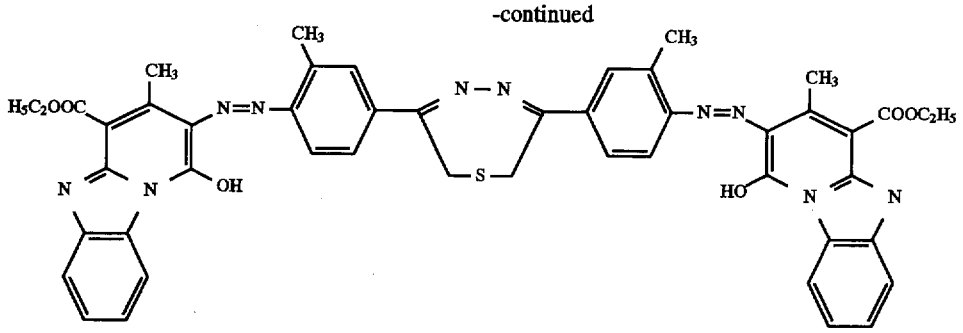
(IV-5)
(5) The general formula (V) and its concrete examples (V-1)–(V-8) are listed below.
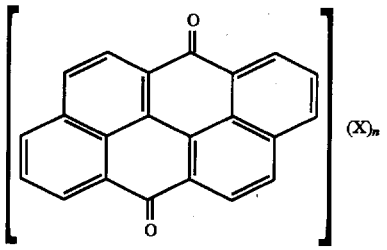
(V)
wherein X stands for one of a hydrogen atom, a halogen group, and a cyano group; and n stands for one integer of from 0 to 4.
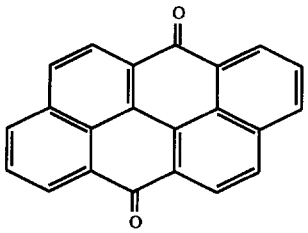
(V-1)
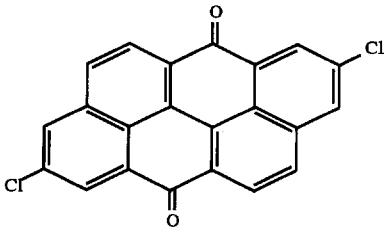
(V-2)
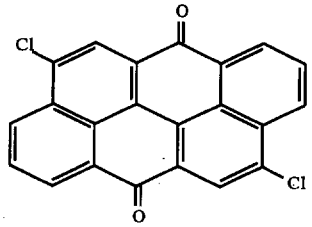
(V-3)
-continued
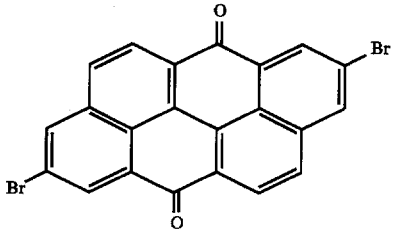
(V-4)
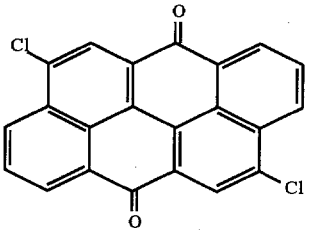
(V-5)
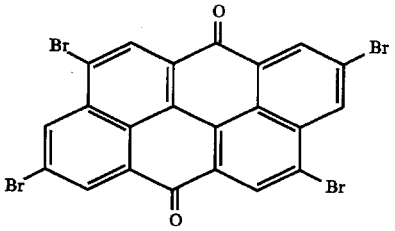
(V-6)
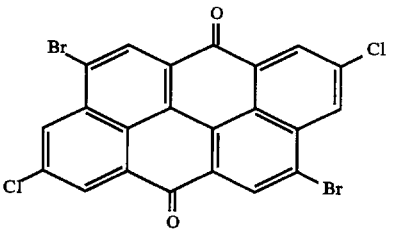
(V-7)
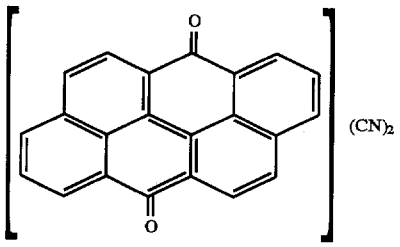
(V-8)
(6) The general formula (VI) and its concrete examples (VI-1)–(VI-7) are listed below.

(VI)

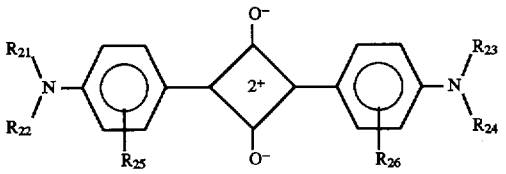

(VI-1)

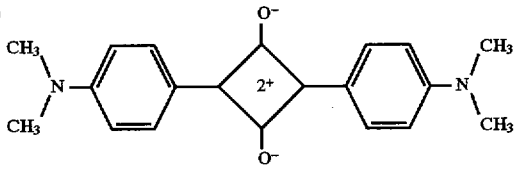

(VI-2)

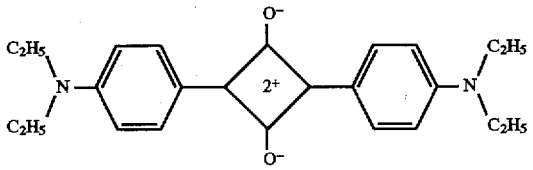

(VI-3)

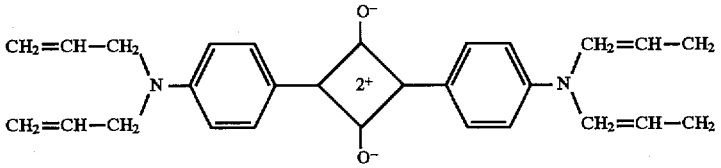

(VI-4)

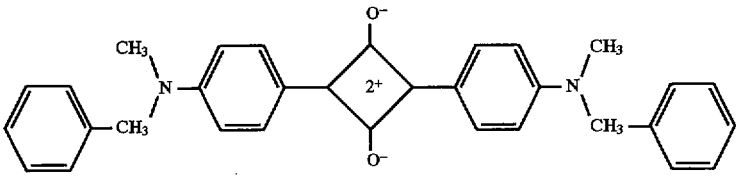

(VI-5)

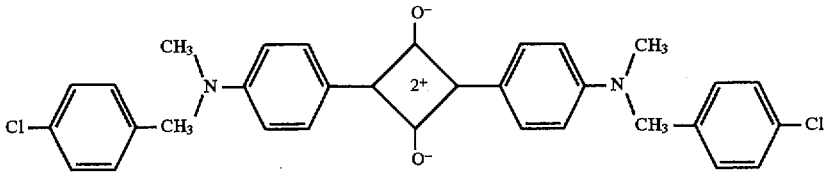

(VI-6)

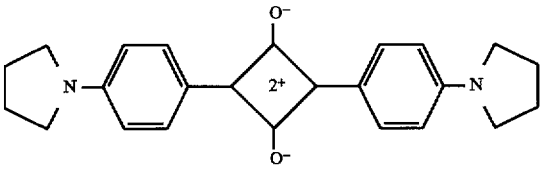

(VI-7)

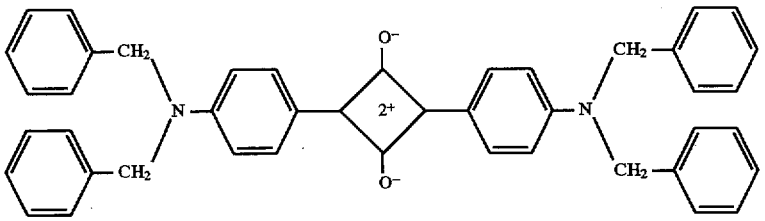

(VI-8)

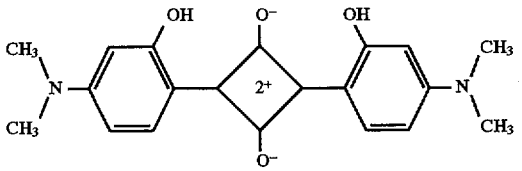

wherein $R_{19}$, $R_{20}$, $R_{21}$, and $R_{22}$ each stand for a substituted or unsubstituted aryl, alkyl, aralkyl, alkenyl group, in which a ring may be formed between $R_{19}$ and $R_{20}$ or between $R_{21}$ and $R_{22}$; $R_{23}$ and $R_{24}$ each stand for one of a hydrogen atom, a halogen atom, a hydroxyl group, an alkyl group, and an alkoxyl group.

The present invention has been described in detail with respect to an embodiment, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A photoconductor for electrophotography, comprising:

an electroconductive substrate; and a photoconductive layer formed on the electroconductive substrate and comprised of at least one distyryl compound represented by general formula (I) as a charge transport material and at least one bisazo compound represented by general formula (II) as a charge generation material:

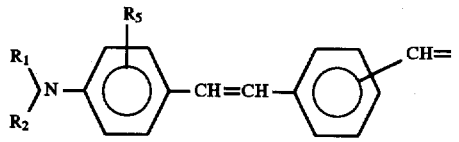

(I)

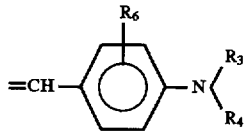

(II)

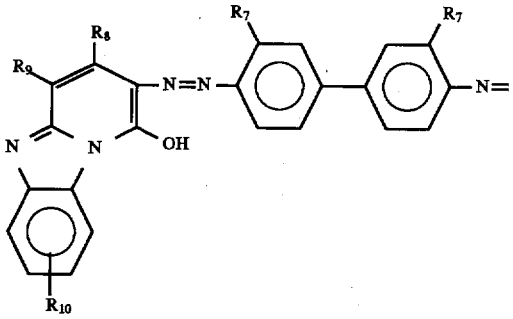

-continued

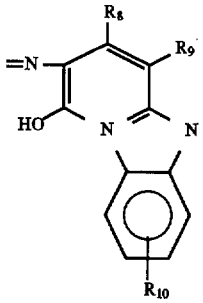

wherein $R_1$, $R_2$, $R_3$, $R_4$, $R_5$, and $R_6$ each is a hydrogen atom, or a substituted or unsubstituted aryl or alkyl group; $R_7$ is one of a halogen atom, an alkyl group, or an alkoxyl group; $R_8$ is a substituted or unsubstituted alkyl group; $R_9$ is one of a hydrogen atom, a cyano group, a carbamoyl group, a carboxyl group, an alkoxycarbonyl group, or an acyl group; $R_{10}$ is one of a hydrogen atom, a halogen atom, a nitro group, or a substituted or unsubstituted alkyl or alkoxyl group.

2. A photoconductor for electrophotography, comprising:

an electroconductive substrate; and a photoconductive layer formed on the electroconductive substrate and comprised of at least one distyryl compound represented by general formula (I) as a charge transport material and at least one bisazo compound represented by general formula (III) as a charge generation material:

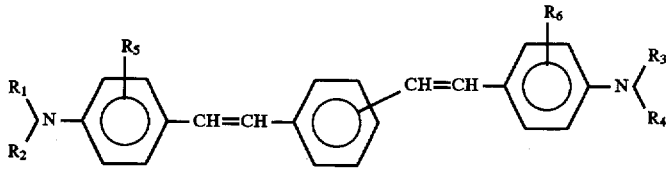

(I)

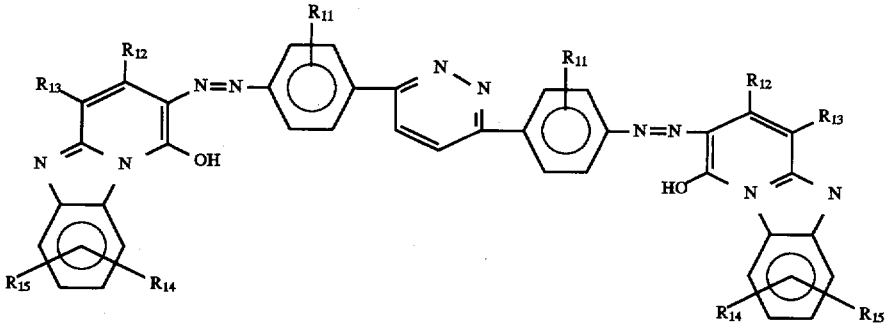

(III)

wherein $R_1$, $R_2$, $R_3$, $R_4$, $R_5$, and $R_6$ each is a hydrogen atom, or a substituted or unsubstituted aryl or alkyl group; $R_{11}$ is one of a hydrogen atom, a halogen atom, or a substituted or unsubstituted alkyl or alkoxyl group; $R_{12}$ is a substituted or unsubstituted alkyl, aryl, or aromatic heterocyclic group; $R_{13}$ is one of a hydrogenatom, cyano group, a carbamoyl group, a carboxyl group, an alkoxycarbonyl group, or an acyl group; $R_{14}$ and $R_{15}$ each is a hydrogen atom, a halogen atom, a nitro group, or a substituted or unsubstituted alkyl or alkoxyl group.

3. A photoconductor for electrophotography, comprising:

an electroconductive substrate; and a photoconductive layer formed on the electroconductive substrate and comprised of at least one distyryl compound represented by general formula (I) as a charge transport material and at least one bisazo compound represented by general formula (IV) as a charge generation material:

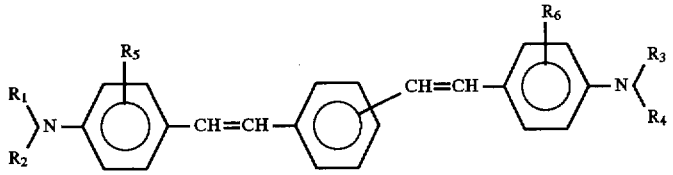

(I)

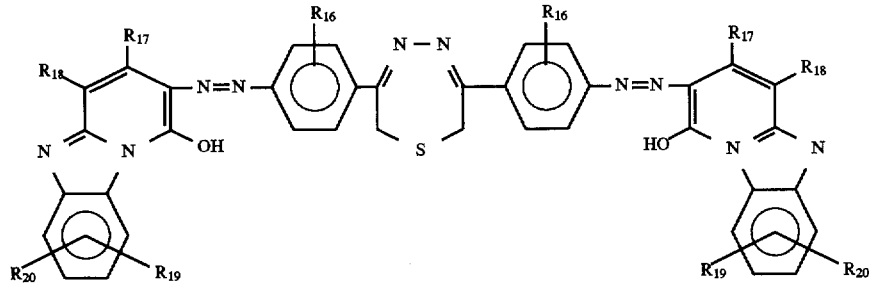

(IV)

wherein $R_1$, $R_2$, $R_3$, $R_4$, $R_5$, and $R_6$ each is a hydrogen atom, or a substituted or unsubstituted aryl or alkyl group; $R_{16}$ is one of a hydrogen atom, a halogen atom, or a substituted or unsubstituted alkyl or alkoxyl group; and $R_{17}$ is a substituted or unsubstituted alkyl, aryl, or aromatic heterocyclic group; $R_{18}$ is one of a hydrogen atom, a cyano group, a carbamoyl group, a carboxyl group, an alkoxycarbonyl group, or an acyl group; $R_{19}$ and $R_{20}$ each is a hydrogen atom, a halogen atom, a nitro group, or a substituted or unsubstituted alkyl or alkoxyl group.

4. A photoconductor for electrophotography, comprising:

an electroconductive substrate; and a photoconductive layer formed on the electroconductive substrate and comprised of at least one distyryl compound represented by general formula (I) as a charge transport material and at least one polycyclic quinone compound represented by general formula (V) as a charge generation material:

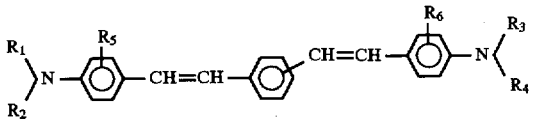

(I)

-continued

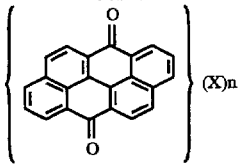

(V)

wherein $R_1$, $R_2$, $R_3$, $R_4$, $R_5$ and $R_6$ each is a hydrogen atom, or a substituted or unsubstituted aryl or alkyl group; X is one of a hydrogen atom, a halogen group, or a cyano group; and n is one integer of from 0 to 4.

5. A photoconductor for electrophotography, comprising:

an electroconductive substrate; and a photoconductive layer formed on the electroconductive substrate and comprised of at least one distyryl compound represented by general formula (I) as a charge transport material and at least one squarylium compound represented by general formula (VI) as a charge generation material:

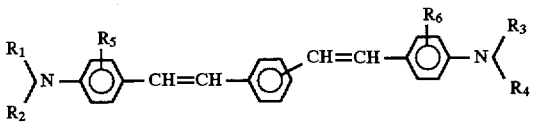

(I)

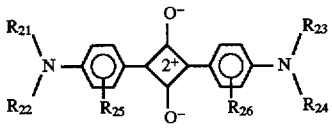

(VI)

wherein $R_1$, $R_2$, $R_3$, $R_4$, $R_5$ and $R_6$ each is a hydrogen atom, or a substituted or unsubstituted aryl or alkyl group; $R_{21}$, $R_{22}$, $R_{23}$, and $R_{24}$ each is a substituted or unsubstituted aryl, alkyl, aralkyl, or alkenyl group, in which a ring may be formed between $R_{21}$ and $R_{22}$ or between $R_{23}$ and $R_{24}$; $R_{25}$ and $R_{26}$ each is one of a hydrogen atom, a halogen atom, a hydroxyl group, an alkyl group, or an alkoxyl group.

* * * * *